US005356317A

United States Patent [19]

Shinji

[11] Patent Number: 5,356,317

[45] Date of Patent: Oct. 18, 1994

[54] MULTI-TERMINAL CONNECTOR

[75] Inventor: Yasuhisa Shinji, Shizuoka, Japan

[73] Assignee: Yazaki Corporation, Tokyo, Japan

[21] Appl. No.: 97,892

[22] Filed: Jul. 28, 1993

[30] Foreign Application Priority Data

Jul. 28, 1992 [JP] Japan ..... 4-052981[U]

[51] Int. Cl.[5] ..... H01R 13/436

[52] U.S. Cl. ..... 439/752

[58] Field of Search ..... 439/752, 595

[56] References Cited

U.S. PATENT DOCUMENTS 4,684,190 8/1987 Clark et al. ..... 439/752
5,167,534 12/1992 Ohsumi ..... 439/752
5,203,722 4/1993 Kinoshita ..... 439/752

FOREIGN PATENT DOCUMENTS 2-12391 3/1990 Japan .
2186748 8/1987 United Kingdom ..... 439/752

*Primary Examiner*—Gary F. Paumen
*Attorney, Agent, or Firm*—Sughrue, Mion, Zinn, Macpeak & Seas

[57] ABSTRACT

Disclosed is a multi-terminal connector for use in connecting wire harnesses and the like. The multi-terminal connector is capable of improving operability and reliability in the process of inserting a terminal by achieving smooth insertion of the terminal while arranging a terminal guiding surface on an inner wall of a terminal accommodating chamber. A terminal guiding surface that is inclined is arranged on a ceiling of a terminal accommodating chamber of a connector housing. When a terminal is inserted slightly obliquely, a holding portion of the terminal comes in contact with the terminal guiding surface to automatically correct the direction of advance of the terminal, thereby preventing defective insertion such as the terminal being caught in the terminal accommodating chamber.

1 Claim, 4 Drawing Sheets

MULTI-TERMINAL CONNECTOR

BACKGROUND OF THE INVENTION

1. Field of the Invention

The device relates to multi-terminal connectors used for connecting wire harnesses or the like applied to electric circuits of vehicles.

2. Related Art

Wire harnesses are generally connected to various electric components by branching a main line into a plurality of lines and inserting male or female connectors provided on ends of such branched lines, the main line being formed by collecting a number of wires while taping. The connecting system with male and female connectors must involve numerous connectors on an instrument panel of an automobile where many switches and meters are congested, thereby entailing not only much labor and time for connection, but also a large space dedicated for connection.

To overcome this problem, the use of multi-terminal connector is proposed. The multi-terminal connector, having more than several tens of terminal accommodating chambers, can intensively accommodate connectors having a small number of terminals per electric component. For example, a connector disclosed in Japanese Patent Examined Publication No. 12391/1990 has many terminal accommodating chambers 2 in a connector housing 1 as shown in FIGS. 7 and 8, and is securely fitted with a counterpart connector housing (not shown) with a locking bolt 3. In order to prevent the accidental removal of terminals 4, terminal holding pins 5, juxtaposed so as to be comblike on a holder 6, are inserted into through holes 7 disposed so as to communicate with the respective terminal accommodating chambers 2 from an outer peripheral wall of the connector housing 1, so that the terminal holding pins 5 can be fitted with holding portions 8 of the respective terminals 4 to thereby hold the terminals 4 in the terminal accommodating chambers 2. The through holes 7 are arranged so as to pass through the respective terminal accommodating chambers 2.

Each through hole 7 is disposed so as to pass through a ceiling 2*a* and side walls 2*b* of the terminal accommodating chamber 2, and is designed to hold the terminal 4 by inserting the terminal 4 into the terminal accommodating chamber 2, inserting the terminal holding pin 5 having such a sectional profile matching the through hole 7 as shown in FIG. 9, and thereafter fitting an end portion 5*a* of the terminal holding pin 5 with a rear end edge 8*a* of the holding portion 8 of the terminal 4.

On the other hand, on a bottom wall 2*c* of the terminal accommodating chamber 2 includes a flexible holding arm 9, so that the terminal holding pin 5 and the terminal 4 can be held doubly by fitting a holding projection 8*c* with the holding arm 9. The holding projection 8*c* is formed by cutting and bending a central portion between a conductor connecting portion 4*a* and an electric contact portion 4*b* of the terminal 4.

However, in the process of inserting the terminal 4 into the terminal accommodating chamber 2, what happens often is that the terminal 4 is inserted slightly obliquely as shown in FIG. 11 and, as a result, a front end edge 8*b* of the holding portion 8 of the terminal 4 abuts against a front wall 7*a* of the through hole 7, thereby preventing the terminal 4 from being inserted into a predetermined position shown in FIG. 10. The operation of adjusting the position of the terminal is extremely labor- and time-consuming. Thus, extremely low productivity and defective insertion of terminals are potential serious problems to be encountered by the multi-terminal connector.

SUMMARY OF THE INVENTION

The device has been made in view of the above circumstances. Accordingly, the object of the device is to provide a multi-terminal connector capable of preventing defective insertion of terminals and improving operability and reliability by disposing a terminal guiding surface on an inner wall of each terminal accommodating chamber of the connector housing.

To achieve the above object, the device is applied to a multi-terminal connector that includes through holes that pass through terminal accommodating chambers from an outer peripheral wall of a connector housing, the terminal accommodating chambers being juxtaposed inside the connector housing. Terminal holding pins are inserted into the through holes so that terminals having been inserted into the terminal accommodating chambers can be fitted with the terminal holding pins and the terminals can be held inside the connector housing. In such a multi-terminal connector, a terminal guiding surface that is inclined in a terminal advancing direction on the inner wall of each terminal accommodating chamber on which the through hole is arranged is formed, so that the terminal can be inserted into the terminal accommodating chamber smoothly.

The multi-terminal connector of the device is provided as arranging the inclined terminal guiding surface on the inner wall of each terminal accommodating chamber of the connector housing. As a result of such construction, when a terminal is inserted into the terminal accommodating chamber slightly obliquely and a part of the terminal brings into contact with the terminal guiding surface, the terminal guiding surface automatically corrects the advancing direction of the terminal along the inclination thereof, so that the terminal can be inserted into a predetermined position. Thus, not only defective insertion of terminals can be prevented, but also the operation of inserting the terminal holding pins to be inserted into the corresponding through holes can be performed smoothly.

DETAILED DESCRIPTION OF THE PREFERRED EMBODIMENTS

Figure 1:
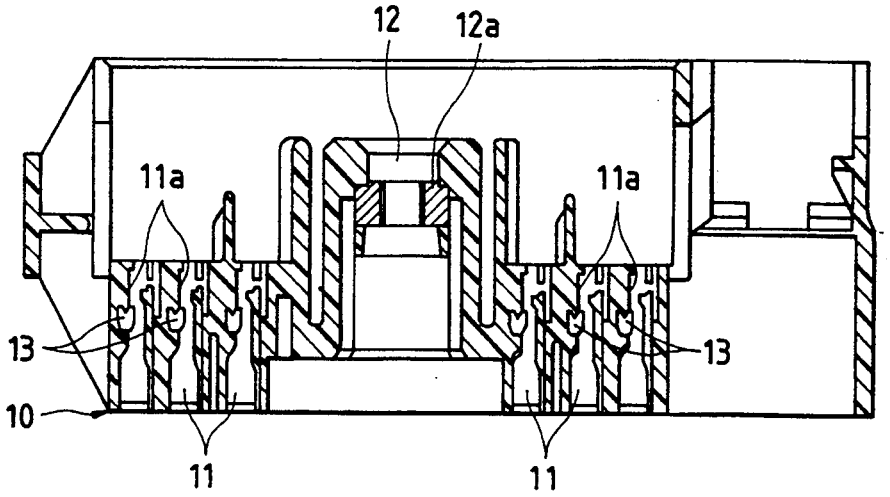
FIG. 1 is a sectional view of a connector housing, which is an embodiment of the device.

FIG. 1 is a longitudinal sectional view of a connector housing 10 constituting a multi-terminal connector, which is an embodiment of the device.

The connector housing 10 includes numerous terminal accommodating chambers 11 therewithin, and has a bolt hole 12 for engageably fixing a counterpart connector housing in the middle thereof. Reference character 12*a* designates a nut. Each terminal accommodating chamber 11 has a through hole 13 so as to pass not only adjacent terminal accommodating chambers but also the connector housing 10 through.

Figure 2:
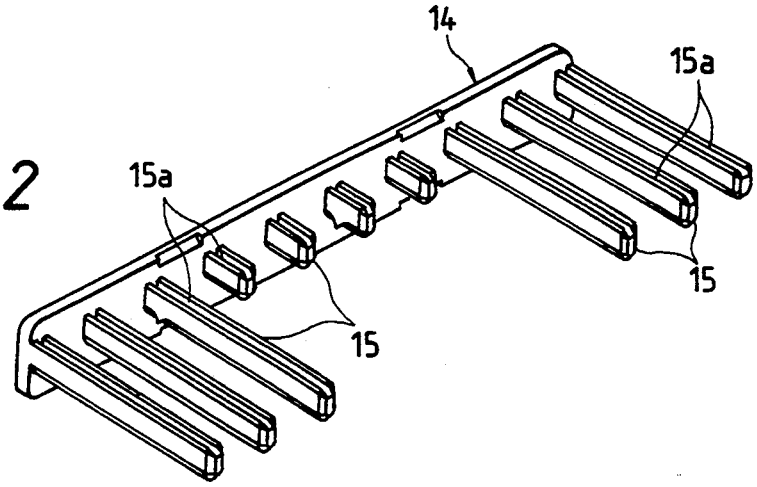
FIG. 2 is a perspective view of terminal holding pins to be inserted into the connector housing of FIG. 1.

Terminals accommodated in the terminal accommodating chambers 11 are collectively held by inserting such terminal holding pins 15 as shown in FIG. 2 into the respective through holes 13. The terminal holding pins 15 are arranged so as to be comblike on a terminal holding holder 14.

Figure 3:
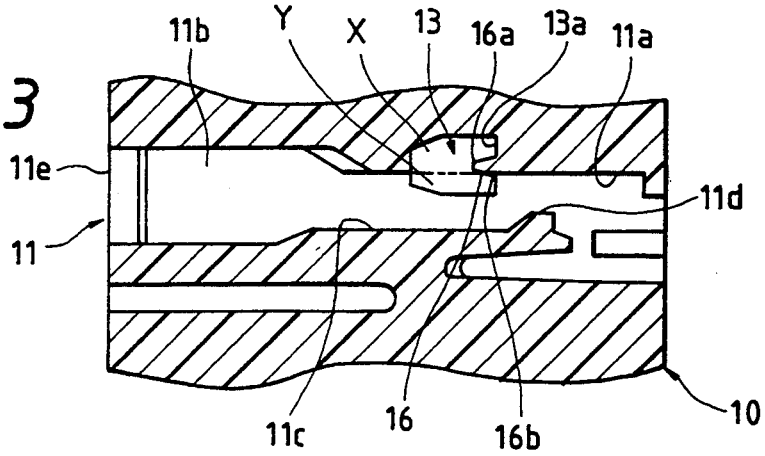
FIG. 3 is an enlarged sectional view of a terminal accommodating chamber of FIG. 1.

As shown in FIG. 3, each terminal accommodating chamber 11 includes four inner walls: a ceiling 11*a*, mutually confronting side walls 11*b*, and a bottom wall 11*c*. The bottom wall 11*c* has a flexible holding arm 11*d* for holding the terminal.

The ceiling 11*a* and the side walls 11*b* have the through hole 13 that passes through the connector housing 10. The through hole 13 is a hole formed of a through hole portion X formed on the ceiling 11*a* and a through hole portion Y formed on the side walls 11*b*.

At a joint 13*a* between the through hole 13 and the ceiling 11*a* that is on a side remote from a terminal inserting inlet 11*e* is a terminal guiding surface 16. The terminal guiding surface 16 is formed as a projection of the ceiling 11*a*. The terminal guiding surface 16 has an inclination lowering in the terminal entering direction relative to the bottom wall 11*c* from a front end portion 16*a* thereof that is on a side close to the terminal inlet portion 11*e* of the terminal accommodating chamber 11 to a joint 16*b* thereof which is even with the ceiling 11*a*.

On the other hand, as shown in FIG. 2, each terminal holding pin 15 is arranged so as to be slidable along the through hole 13 by disposing grooves 15*a* in the longitudinal direction thereof, the grooves 15*a* matching the profile of the terminal guiding surface 16.

An operation of the terminal guiding surface 16 at the time a terminal is inserted thereinto will be described next.

Figure 4:
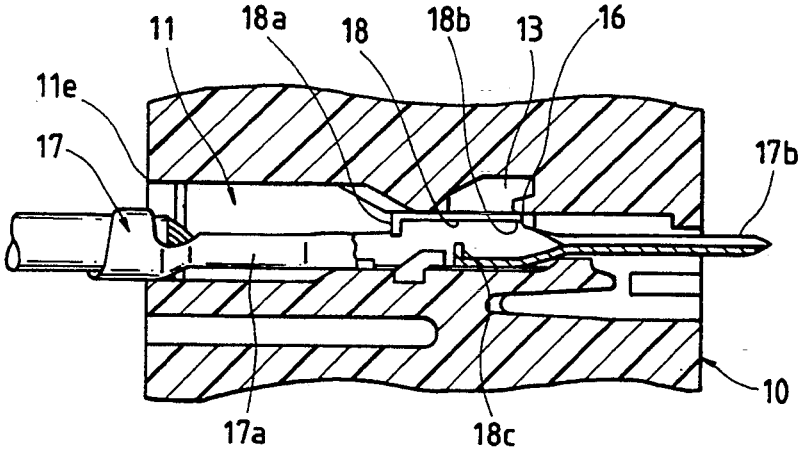
FIG. 4 is a diagram illustrative of a state in which a holding portion of a terminal is in contact with a terminal guiding surface of FIG. 3.

FIG. 4 shows a state in which a terminal 17 has been inserted into the chamber 11 from the terminal inserting inlet 11*e*.

The terminal 17 includes a conductor connecting portion 17*a* and an electric contact portion 17*b*. By cutting and bending a metal plate forming the terminal 17, a holding portion 18 and a holding projection 18*c* are arranged between the conductor connecting portion 17*a* and the electric contact portion 17*b*. The holding projection 18*c* is disposed at a position confronting the holding portion 18.

Figure 5:
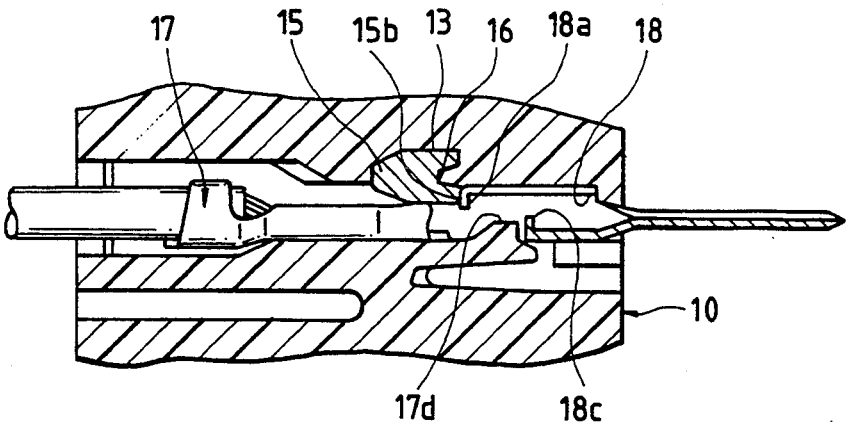
FIG. 5 is a sectional view showing a state in which the terminal inserted into the terminal accommodating chamber of FIG. 3 is held by the terminal holding pin.

In the process of inserting the terminal 17, when a front edge portion 18*b* of the holding portion 18 of the terminal 17 comes in contact with the terminal guiding surface 16, the terminal 17 slides along the inclination of the terminal guiding surface 16 as it advances as shown in FIG. 4 and is automatically inserted into a predetermined position as shown in FIG. 5. At this point, the terminal 17 is held inside the terminal accommodating chamber 11 by the flexible holding arm 11*d* engaging with the holding projection 18*c* of the terminal 17.

By inserting the terminal holding pin 15 into the through hole 13, the terminal 17 is doubly held with a rear edge portion 18*a* of the holding portion 18 of the terminal 17 engaging an end portion 15*b* of the terminal holding pin 15.

Since the terminal holding pin 15 can be inserted with the terminal guiding surface 16 and the grooves 15*a* being used as references, the terminal holding pin 15 can be inserted into the connector housing 10 with ease.

Figure 6:
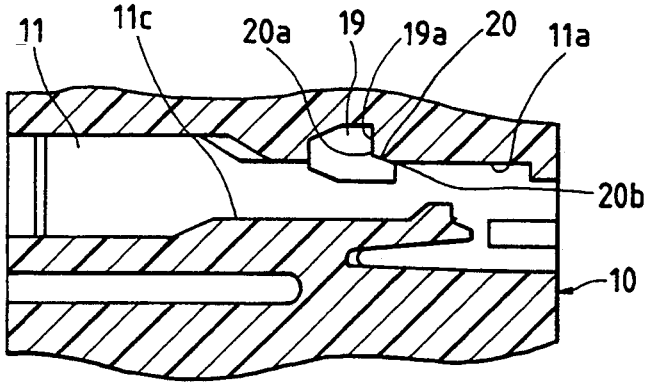
FIG. 6 is a sectional view showing the profile of a through hole, which is another embodiment of the device.
Figure 7:
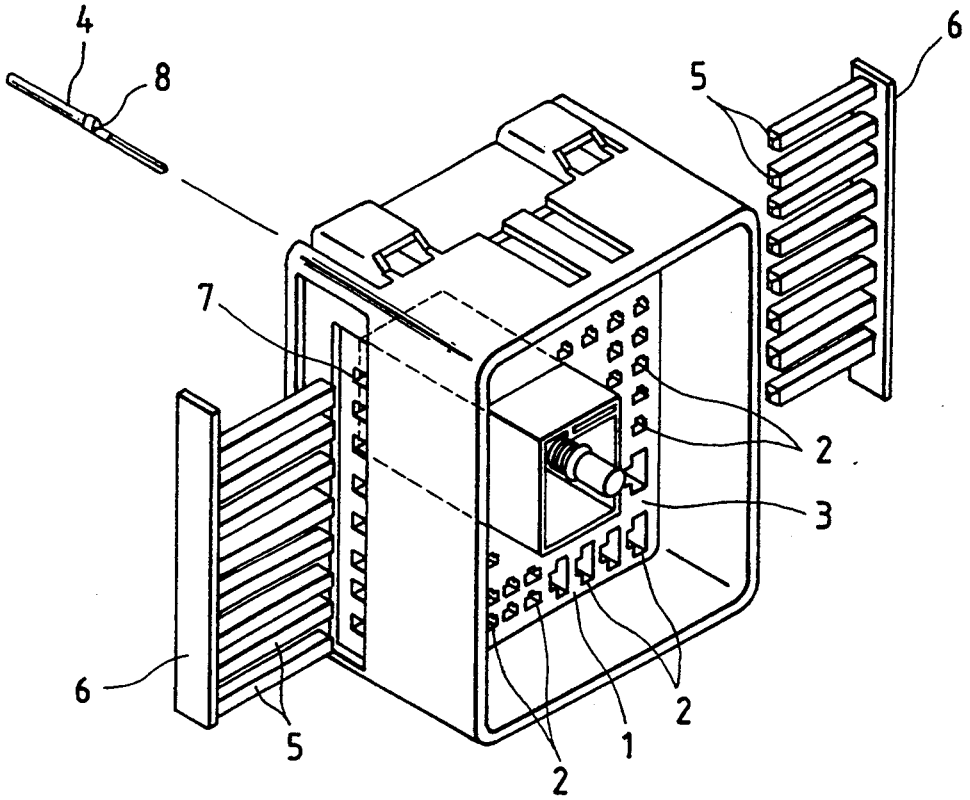
FIG. 7 PRIOR ART
FIG. 7 is a perspective view of a housing of a conventional multi-terminal connector.
Figure 8:
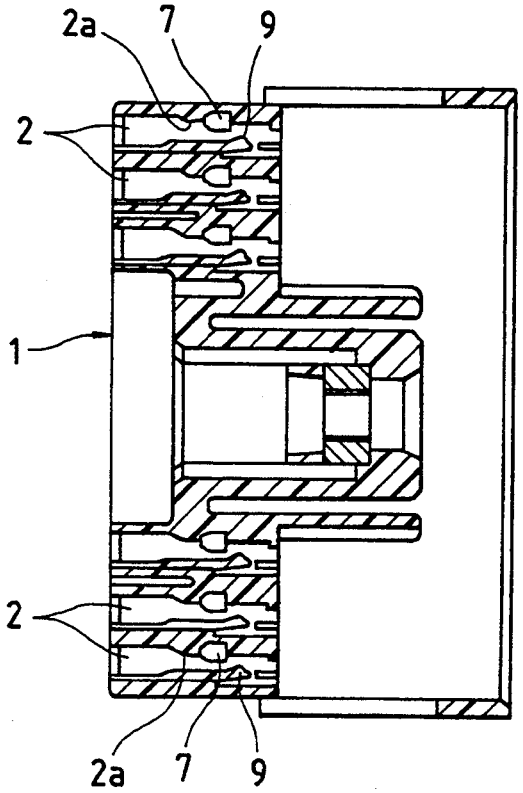
FIG. 8 PRIOR ART
FIG. 8 is a longitudinal sectional view of the housing of FIG. 7.
Figure 9:
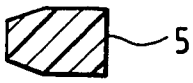
FIG. 9 PRIOR ART
FIG. 9 is a sectional view of a terminal holding pin of FIG. 7.
Figure 10:
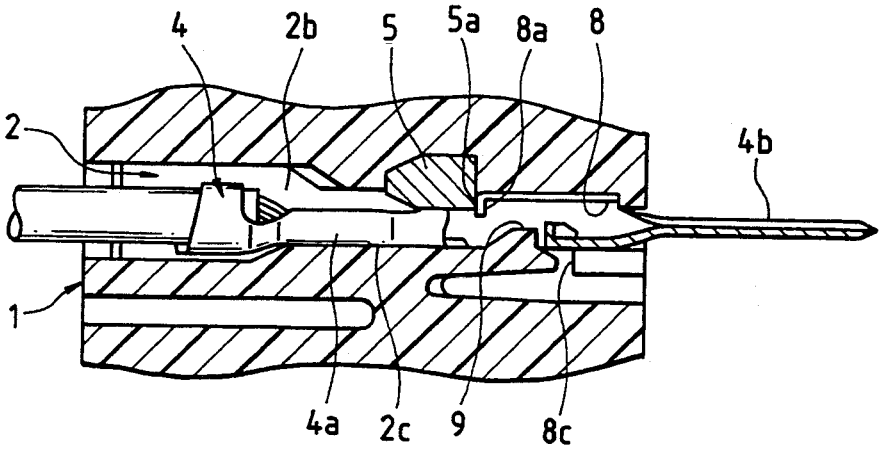
FIG. 10 PRIOR ART
FIG. 10 is a sectional view showing a state in which a terminal inserted into a terminal accommodating chamber of FIG. 8 is held by the terminal holding pin.
Figure 11:
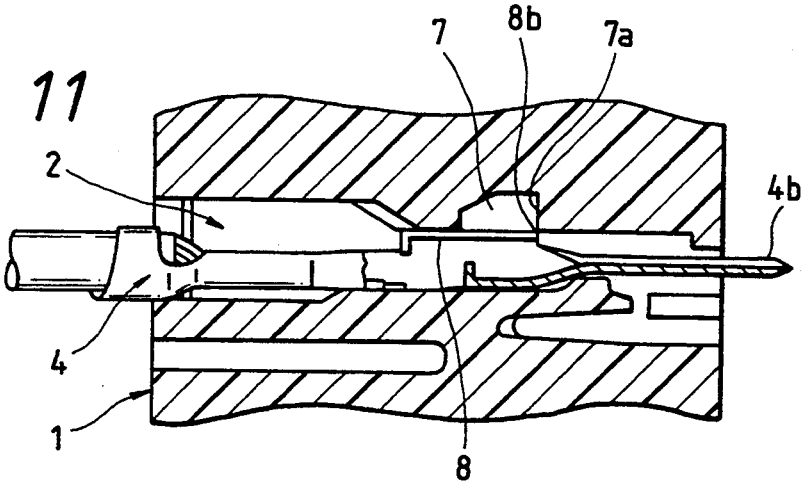
FIG. 11 PRIOR ART
FIG. 11 is a diagram illustrative of a state in which a holding portion of the terminal abuts against a through hole when the terminal is being inserted into the terminal accommodating chamber of FIG. 8.

The through hole may take not only such form that the terminal guiding surface 16 of the ceiling 11*a* of the terminal accommodating chamber 11 projects toward the inside of the through hole as shown in the above-described embodiment, but also such form that, as shown in FIG. 6, a terminal guiding surface 20 is formed so as to incline from the ceiling 11*a* to a front wall 19*a* of a through hole 19. In a manner similar to the terminal guiding surface 16, the terminal guiding surface 20 has an inclination lowering from a joint 20*a* with the through hole 19 to a joint 20*b* with the ceiling 11*a* toward the bottom wall 11*c*. A terminal holding pin to be inserted into the through hole 19 may be such that the sectional profile thereof matches the through hole 19.

According to the device, the terminal guiding surface that is inclined is arranged in the terminal accommodating chamber of the connector housing. Therefore, in the case where a terminal is inserted slightly obliquely into the terminal accommodating chamber, the direction in which the terminal advances is automatically corrected along the inclination of the terminal guiding surface, thereby allowing the terminal to be inserted into a predetermined position surely. As a result, the terminal is no longer caught up at the time of insertion, thereby preventing defective insertion of terminals as well as facilitating smooth insertion of terminal holding pins. Thus, a multi-terminal connector with remarkable improvements in operability and reliability can be provided.

What is claimed is:

1. A multi-terminal connector, comprising:

a connector housing having a plurality of terminal accommodating chambers disposed therein and a plurality of through holes which intersect said terminal accommodating chambers;

terminal holding pins which, when fitted into said through holes, respectively hold terminals in said terminal accommodating chambers; and terminal guide means for smoothly inserting said terminal into said terminal accommodating chambers in a terminal advancing direction, said terminal guide means including a projection having an inclination surface descending in said terminal advancing direction, said terminal holding pins each having a groove receiving said terminal guide projection therein in the longitudinal direction so as to be slidable along said through hole.

* * * * *